US011478952B1

(12) United States Patent
Collier

(10) Patent No.: US 11,478,952 B1
(45) Date of Patent: Oct. 25, 2022

(54) LOG CUTTER

(71) Applicant: Charles R. Collier, Kingston, TN (US)

(72) Inventor: Charles R. Collier, Kingston, TN (US)

( * ) Notice: Subject to any disclaimer, the term of this patent is extended or adjusted under 35 U.S.C. 154(b) by 0 days.

(21) Appl. No.: 17/544,646

(22) Filed: Dec. 7, 2021

(51) Int. Cl.

| | |
|---|---|
| ***B27B 15/08*** | (2006.01) |
| ***B27B 1/00*** | (2006.01) |
| ***B27B 31/00*** | (2006.01) |
| ***B27B 29/08*** | (2006.01) |

(52) U.S. Cl.
CPC ..... *B27B 15/08* (2013.01); *B27B 1/005* (2013.01); *B27B 1/007* (2013.01); *B27B 29/08* (2013.01); *B27B 31/003* (2013.01)

(58) Field of Classification Search
CPC ..... B27B 1/00; B27B 1/002; B27B 1/005; B27B 15/00; B27B 15/02; B27B 15/04; B27B 15/08; B27B 31/003; B27B 31/006; B27B 25/02; B27B 25/04; B27B 29/04; B27B 29/08; B27M 1/08; B27L 5/004; B27L 5/008
See application file for complete search history.

(56) References Cited

U.S. PATENT DOCUMENTS

| | | | | |
|---|---|---|---|---|
| 633,028 | A | 9/1899 | Mcdonough | |
| 684,919 | A | 10/1901 | Dees | |
| 1,824,381 | A | 9/1931 | Sorensen et al. | |
| 2,870,803 | A | 1/1959 | Eppler | |
| 4,111,247 | A * | 9/1978 | Hasenwinkle | B27B 1/005 144/350 |
| 4,422,487 | A | 12/1983 | McCurdy | |
| 4,665,786 | A | 5/1987 | Shields | |
| 4,867,213 | A | 9/1989 | Bolton et al. | |
| 5,090,463 | A | 2/1992 | Jeantelot | |
| 5,421,385 | A | 6/1995 | McGee | |
| 5,560,409 | A | 10/1996 | Knorr | |
| 5,806,401 | A | 9/1998 | Rajala et al. | |
| 6,374,881 | B1 * | 4/2002 | Wiklund | B27B 1/00 144/377 |
| 8,261,645 | B2 | 9/2012 | Dale | |
| 10,589,441 | B2 * | 3/2020 | Hirmke | E04C 2/12 |
| 2010/0031798 | A1 * | 2/2010 | Wang | B27B 15/08 83/800 |

FOREIGN PATENT DOCUMENTS

| | | | |
|---|---|---|---|
| GB | 2045679 | A | 11/1980 |

* cited by examiner

*Primary Examiner* — Matthew Katcoff
(74) *Attorney, Agent, or Firm* — Luedeka Neely Group, PC

(57) ABSTRACT

A sawmill and method for sawing a log. The sawmill includes a transfer conveyor to convey a log quarter wedge segment to a log transport rig configured to orient the log quarter wedge segment so that an apex of the log quarter wedge segment is oriented in a downward direction. The log transport rig moves the log quarter wedge segment through a band saw configured to saw the log quarter wedge segment into two log eighth wedge segments. A transfer conveyor is provided to gather the two log eighth wedge segments from the log transport rig and feed the two log eighth wedge segments sequentially to a resawing rig comprising a conveying device and from two to six band saws configured to saw boards from the each of two log eighth wedge segments in succession as each of the two log eighth wedge segments are transported through the resawing rig.

20 Claims, 7 Drawing Sheets

LOG CUTTER

TECHNICAL FIELD

The disclosure is directed to log cutters and methods for sawing logs from a log core segment, and in particular for sawing barrel staves and core sawed lumber from logs.

BACKGROUND AND SUMMARY

Logs are sawn for a number of different purposes and the method used to saw the logs is related to how the wood will be used. For example, furniture makers desire logs to be sawn so that the wood grain is prominent. Logs sawn for the purpose of making wine and whisky barrels requires that the grain be oriented in a manner that increases the fluid retaining properties of the barrels.

Techniques for sawing logs include riftsawn, plainsawn and quartersawn techniques. It is desirable to provide the highest yield of usable wood from a log, however, such techniques are usually manpower intensive and time consuming. For example, the technique used to saw a log 10 in FIGS. 1 and 2 provides quartersawn 12 and riftsawn 14 segments for furniture making. The logs are first quartered as shown by four log quarter wedges 16 in FIG. 2 and then cut to provide individual lumber pieces 12 and 14 as shown in FIGS. 1 and 2. The wedge-shaped segments 18 resulting from such sawing technique are not particularly useful. However, the sawing technique used to cut a log shown in FIGS. 3 and 4 provides the most quartersawn lumber 20 from a log 22. The log shown in FIGS. 3 and 4 is first quartered to provide log quarter wedges 34 and then the quarter sections are cut to form two log eighth wedges 44. In order to provide a high yield of lumber from the log 22, the log it typically fed through a saw mill several times while rotating the log to make the correct cuts. Thus, the sawing operation is time consuming and highly labor intensive. What is needed is an automated system for sawing a log to make lumber suitable for barrel staves and other purposes that is more efficient and less labor intensive and provides the highest yield of lumber from a log.

With regard to the foregoing an embodiment of the disclosure provides a sawmill and method for sawing a log. The sawmill includes a supply conveyor to convey a log quarter wedge segment to a log transport rig configured to orient the log quarter wedge segment so that an apex of the log quarter wedge segment is oriented in a downward direction. The log transport rig moves the log quarter wedge segment through a band saw configured to saw the log quarter wedge segment into two log eighth wedge segments. A transfer conveyor is provided to gather the two log eighth wedge segments from the log transport rig and feed the two log eighth wedge segments sequentially to a resawing rig comprising a conveying device and from two to six band saws configured to saw boards from the each of two log eighth wedge segments in succession as each of the two log eighth wedge segments are transported through the resawing rig.

In some embodiments, each of the two to six band saws is set at a different height above the conveying device.

In some embodiments, the resawing rig includes three band saws in succession. In other embodiments, the resawing rig includes four band saws in succession. In other embodiments, the resawing rig includes five band saws in succession. In still other embodiments, the resawing rig includes six band saws in succession.

In some embodiments, the resawing rig includes at least two rollers attached to the resawing rig at an angle of 45 degrees, wherein the at least two roller bearings are configured to contact a flat face of each of the two log eighth wedge segments as each of the two log eighth wedge segments are transported through the resawing rig, and wherein each of the at least two rollers comprises a shaft and a plurality of roller bearings on the shaft.

In some embodiments, at least one of the at least two rollers are disposed between adjacent band saws.

In some embodiments, the log transport rig further includes a first log hold-down fixture.

In some embodiments, the resawing rig includes a second log hold-down fixture.

In some embodiments, there is provided method for sawing a log. The method includes feeding a log quarter wedge segment from a supply conveyor to a log transport rig; orienting the log quarter wedge segment in the log transport rig so that an apex of the log quarter wedge segment is in a downward direction; transporting the log quarter wedge segment through a band saw; sawing the log quarter wedge segment into two log eighth wedge segments; transporting the two log eighth wedge segments on a transfer conveyor in succession through a resawing rig containing two to six band saws; and sawing two or more boards parallel to one face of each of the two log eighth wedge segments as each of the two log eighth wedge segments are transported on a conveying device through the resawing rig.

In some embodiments, each of the two or to six band saws is set at a different height above the conveying device in order to saw lumber from each of the two log eighth wedge segments in a direction parallel to a plane defined by the conveying device.

The apparatus and method described herein provides an efficient, cost-effective method for sawing logs while reducing the amount of manpower and space required to provide a high production rate of lumber.

DETAILED DESCRIPTION OF EXEMPLARY EMBODIMENTS

Figure 1:
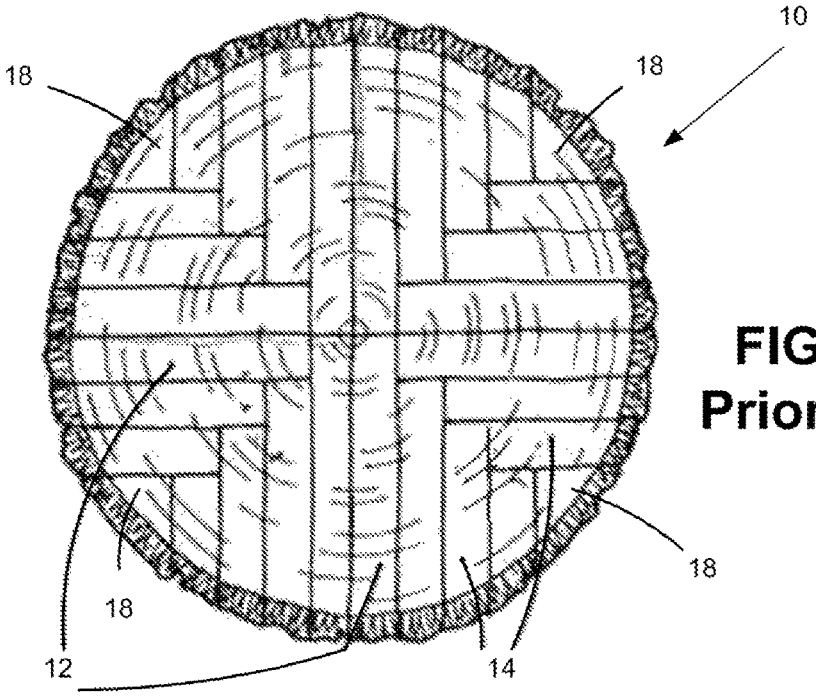
FIG. 1 Prior Art
FIGS. 1 and 2 is a cross-sectional view of a log cut according to a prior art process.
Figure 2:
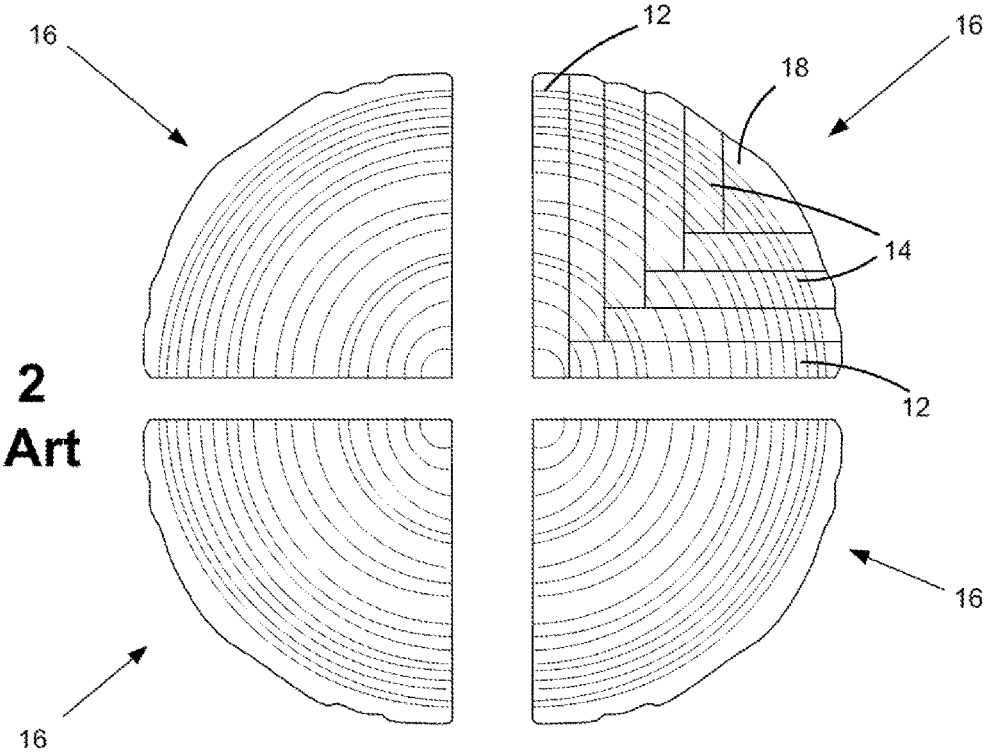
FIG. 2 Prior Art
Figure 3:
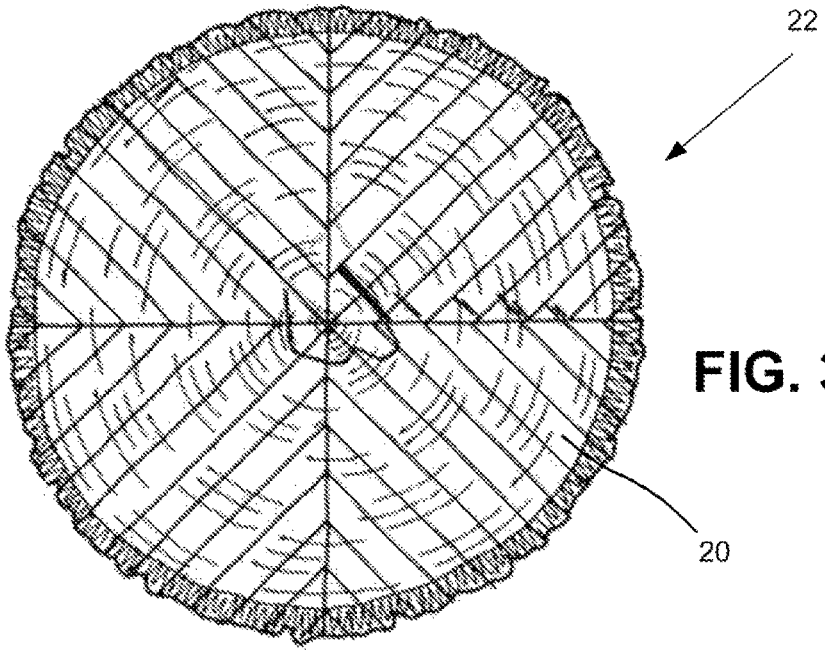
FIGS. 3 and 4 are cross-sectional views of a log cut according to an embodiment of the disclosure.
Figure 4:
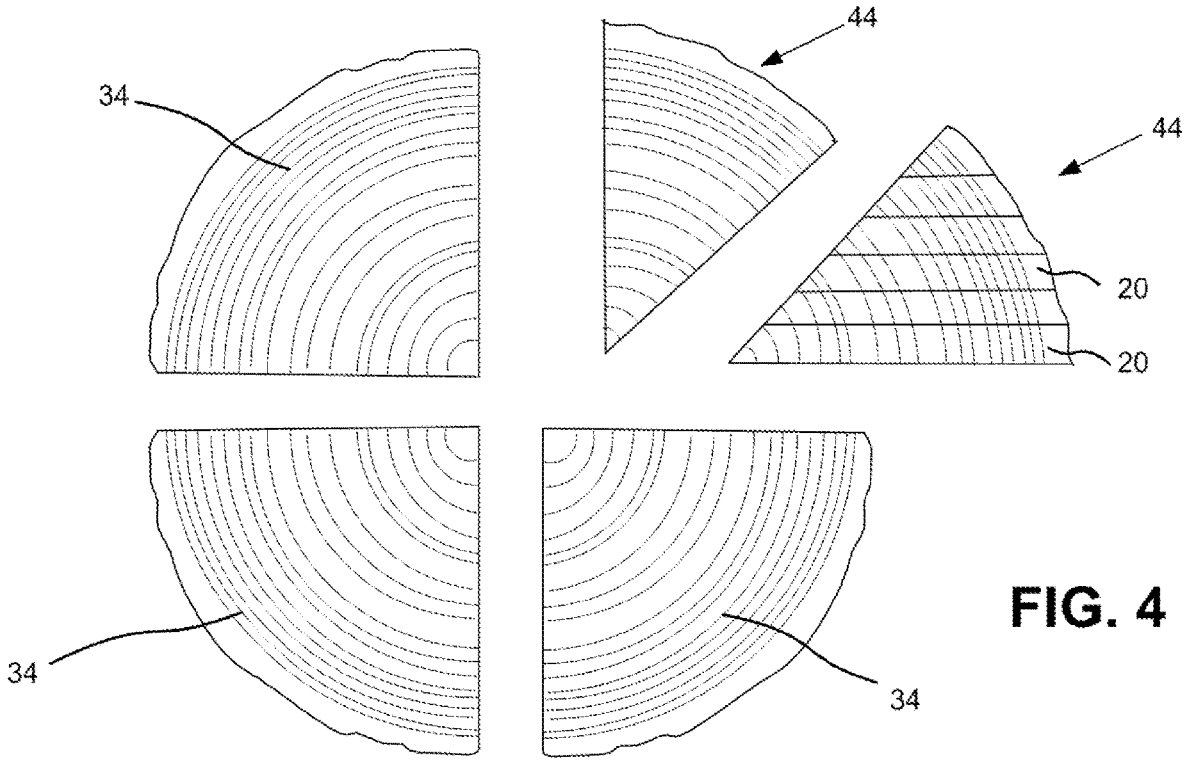
Figure 5:
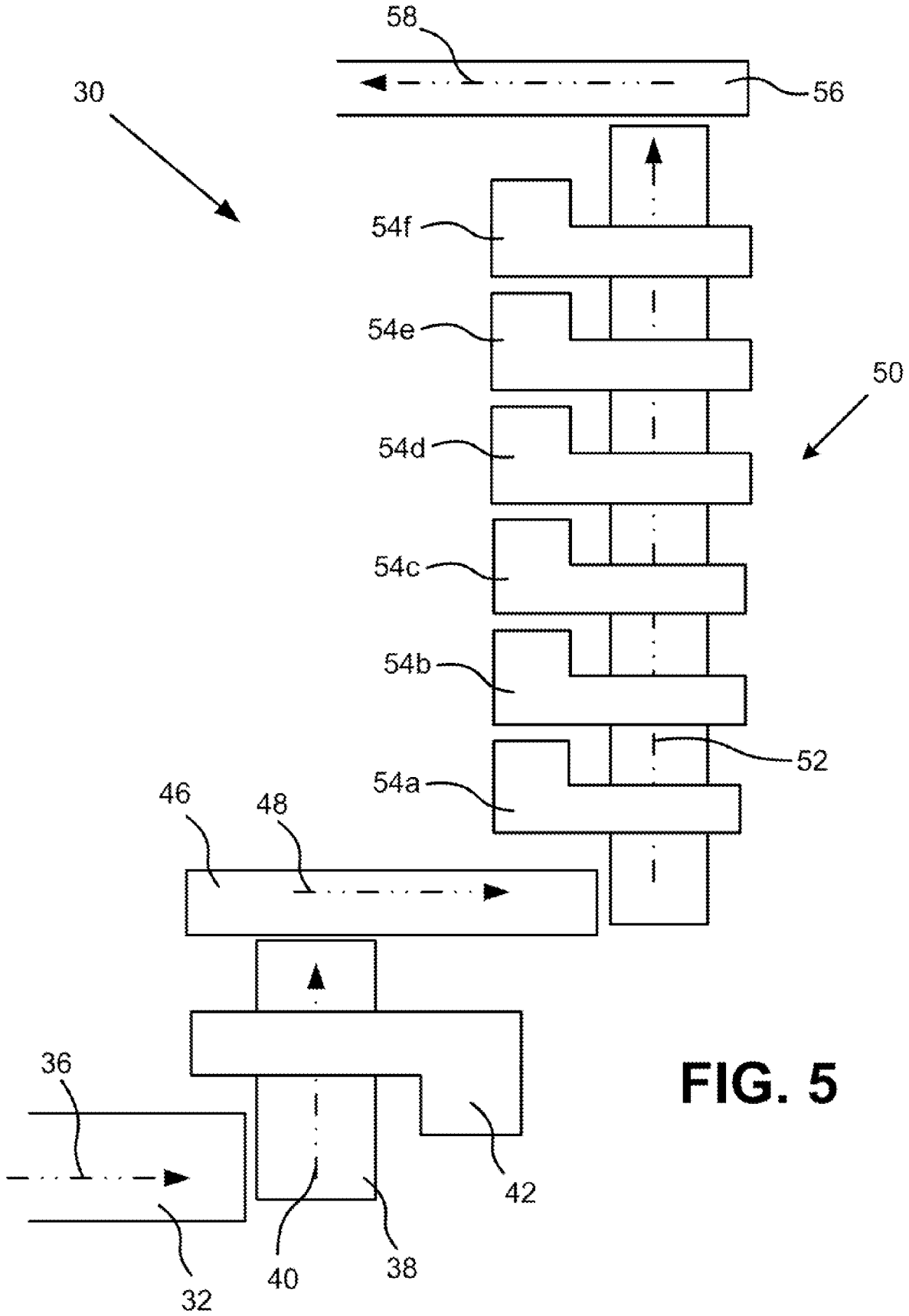
FIG. 5 is a schematic layout view of portions of a sawmill according to the disclosure.

With reference to FIG. 5, there is shown a schematic layout for a log cutting system 30 according to an embodiment of the disclosure. The system 30 includes a supply conveyor 32 for providing log quarter wedges 34 in the direction of arrow 36 to the log transport rig 38. The log transport rig 38, described in more detail below, moves the log quarter wedges 34, one at a time in the direction of arrow 40 through a band saw 42 that is configured to saw the log quarter wedges into two log eighth wedges 44. A first transfer conveyor 46 moves the log eighth wedges 44 in succession in the direction of arrow 48 to a resawing rig 50 wherein the log eighth wedges are moved in the direction of arrow 52 through one or more band saws 54*a*-54*f*, wherein each of the band saws 54A-54*f* is set at a different height above a conveying device of the resawing rig 50 in order to saw individual boards from each of the log eighth wedges 44 as described below. A second transfer conveyor 56 transports the lumber from the resawing rig 50 in the direction of arrow 58 to further processing units to form barrel staves or other products or back to the resawing rig 50, in the case of the use of less than six band saws 54*a*-54*f*.

Figure 6:
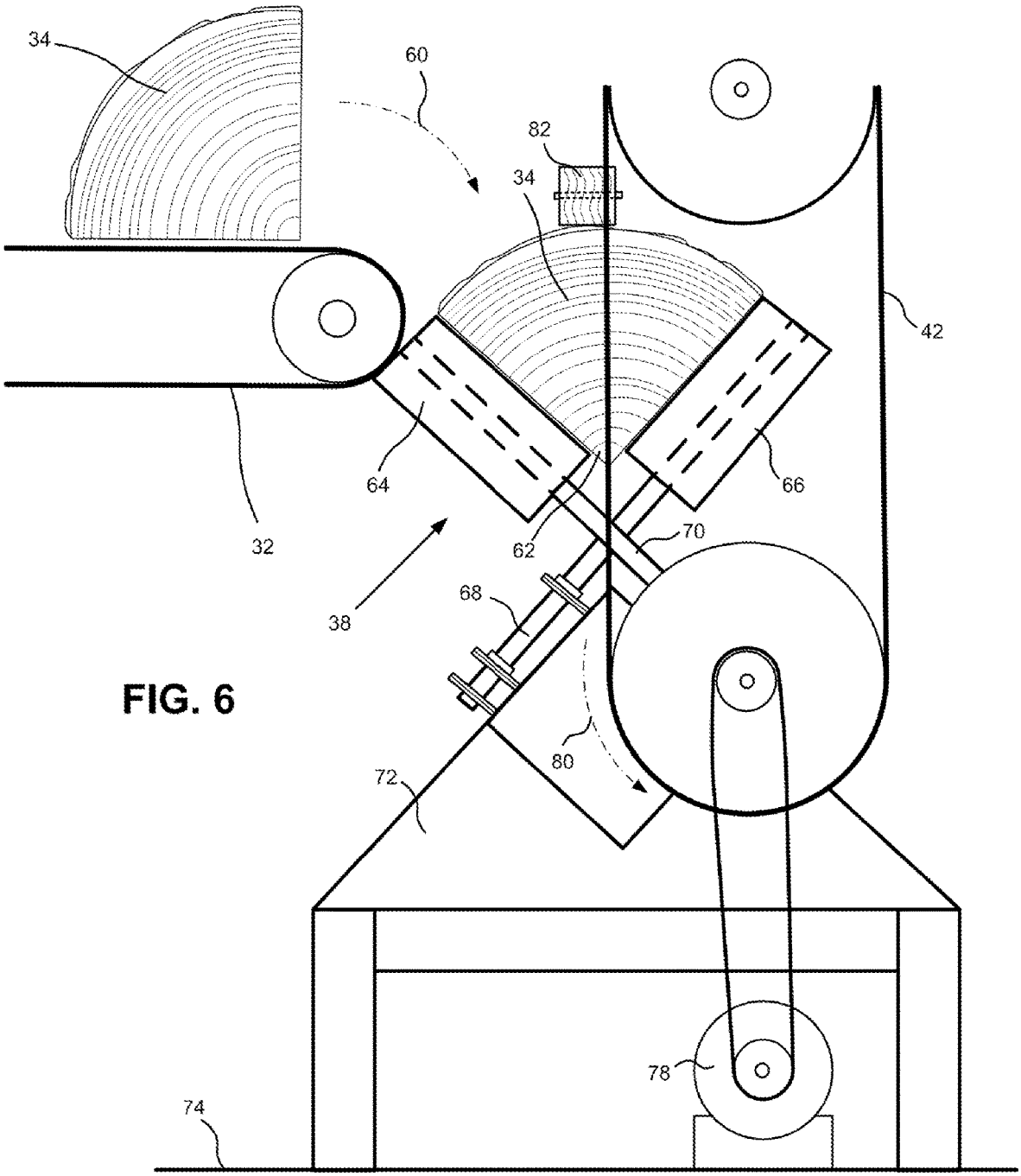
FIG. 6 is an end schematic view, not to scale, of a portion of a saw and transport rig for cutting a log quarter wedge into two log eighth wedges.
Figure 7:
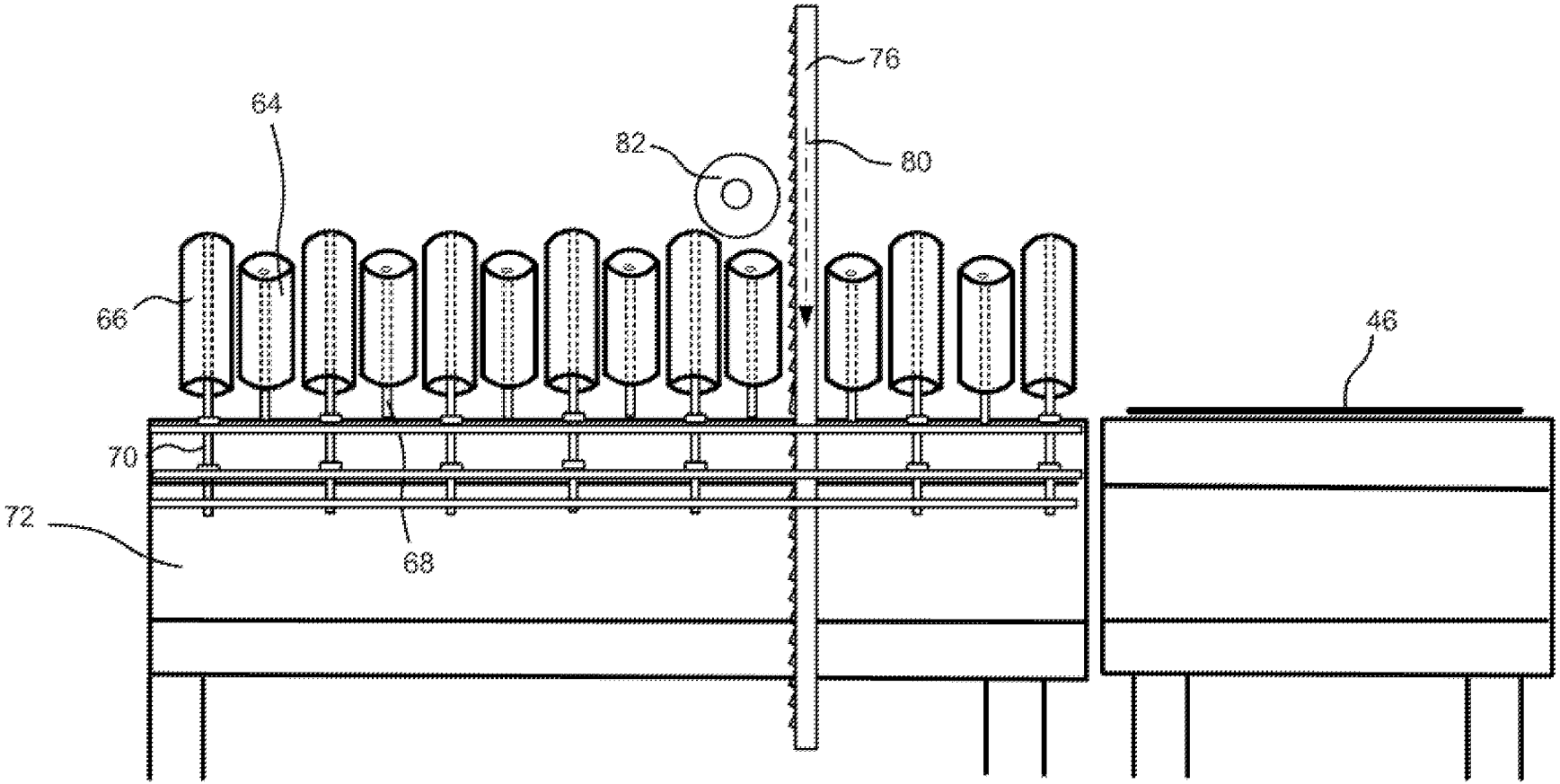
FIG. 7 is a side schematic, elevational view, not to scale, of the saw and transport rig of FIG. 4.

Details of the log transport rig 38 are shown in more detail in FIGS. 6 and 7. FIG. 6 is an end view of the transport rig 38 and band saw 42 for cutting a log quarter wedge 34 into two log eighth wedges 44. The log quarter wedge 34 is transported on the supply conveyor 32 which causes the log quarter wedge 34 to fall into the log transport rig 38 as indicated by arrow 60, so that an apex 62 of the log quarter wedge is directed in a downward direction in the log transport rig 38.

The log transport rig 38 includes rollers 64 and 66 that are mounted on shafts 68 and 70 attached to a saw table 72 so that each of the rollers 64 and 66 is disposed at an angle of 45 degrees relative to a horizontal plane defined by a floor 74. A separate motor (not shown) may be used to drive one or both of the shafts 68 and 70 in order to advance the log quarter wedge 34 through a saw blade 76 that is vertically aligned through the apex 62 of the log quarter wedge 34. In a preferred embodiment, both of the rollers 64 and 66 are powered in order to move the log quarter wedge 44 through the log transport rig 38. The band saw 42 may be powered by a separate motor 78. While a band saw 42 is illustrated, it will be appreciated that a circular saw may also be configured to saw the log quarter wedge 34 into two log eighth wedges. The direction of travel of the saw or band saw 76 is indicated by arrow 80 so that the cutting motion of the saw blade will tend to force the log quarter wedge 34 in a downward direction. In some embodiments, a hold-down device or powered wheel 82 may be used to hold the log quarter wedge 34 adjacent to the rollers 64 and 66 and to urge the log through the transport rig 38 during the sawing operation. The hold-down device or powered wheel 82 may be spring-loaded or activated by a hydraulic device that maintains contact between hold-down device or powered wheel 83 and the log quarter wedge 34 as shown. The hold-down device or powered wheel 82 may be attached to log transport rig 38 or saw table 72 by any means known by those skilled in the art. Accordingly, for visualization purposes of other details of the rig 38, the details of the hold-down or powered wheel 82 are not shown.

Figure 8:
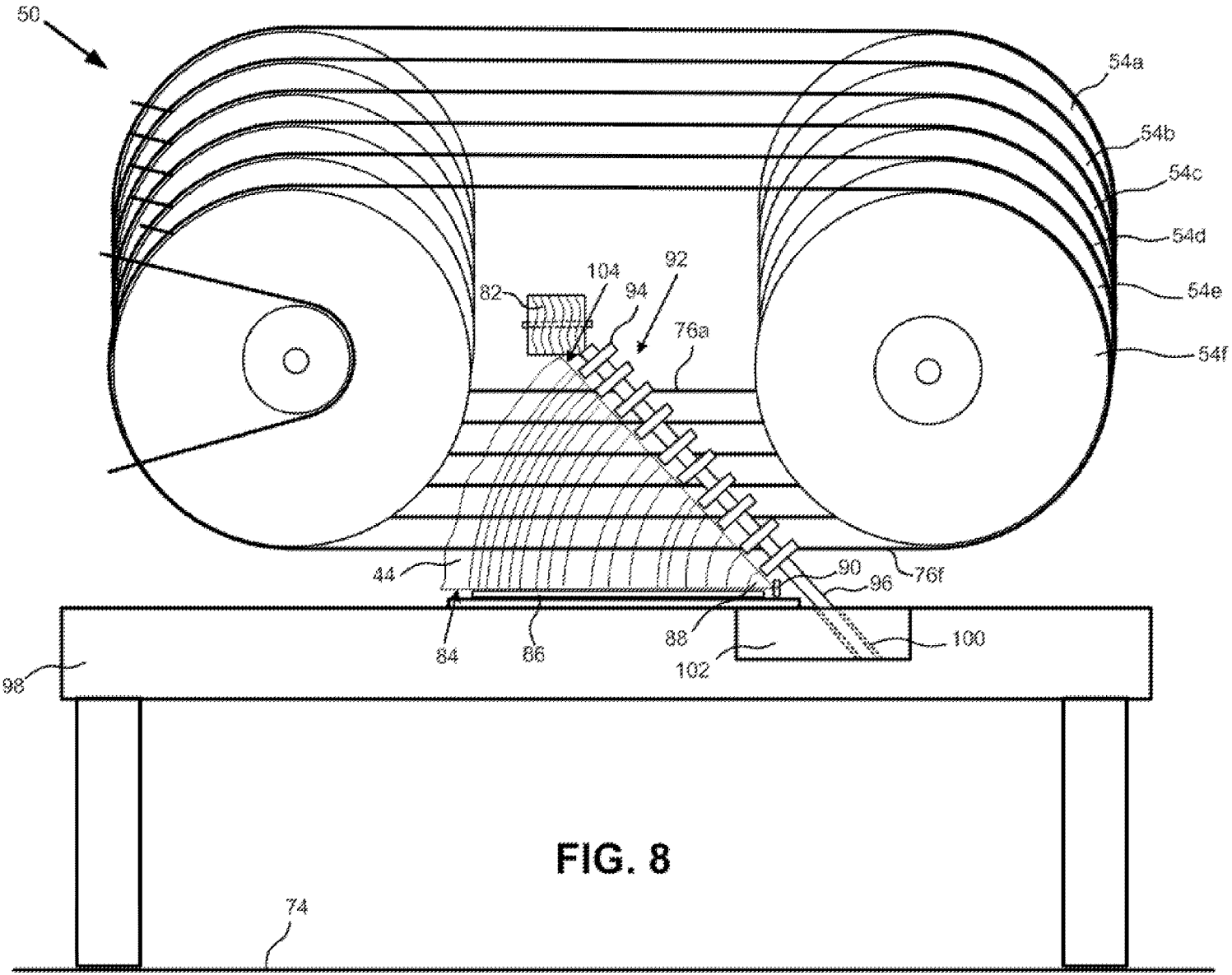
FIG. 8 is an end schematic view, not to scale, of a resawing rig according to an embodiment of the disclosure.
Figure 9:
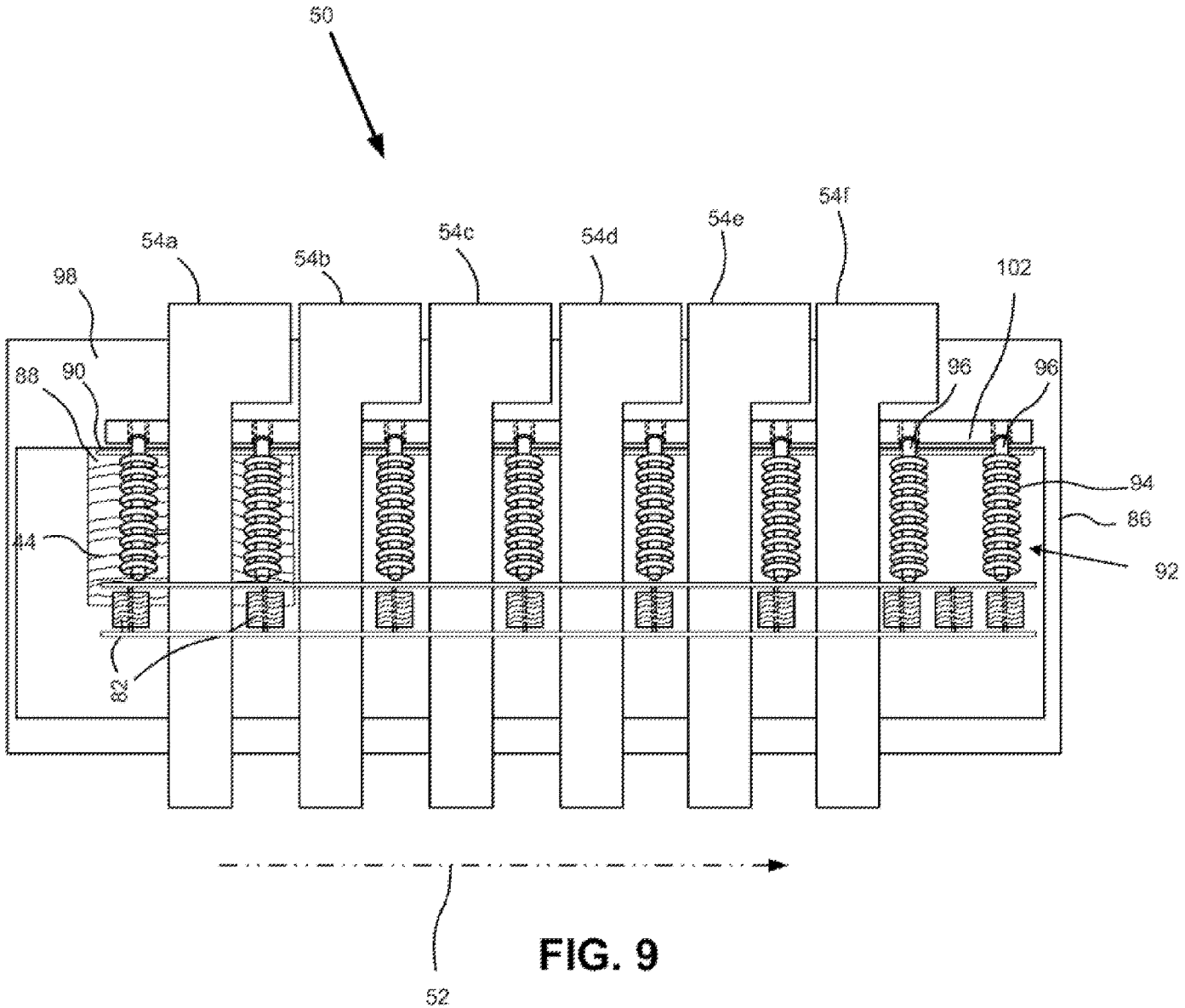
FIG. 9 is top plan schematic view, not to scale, of the resawing rig of FIG. 6.

Next, the log eighth wedges 44 are conveyed by the first transfer conveyor 46 to the resawing rig 50 illustrated in FIGS. 8 and 9. Each log eighth wedge 44 is positioned so that a flat face 84 of the wedge 44 is adjacent to conveying device 86 that is configured to move the wedge 44 through the resawing rig 50. The conveying device 86 may be selected from a belt conveyor, a roller conveyor, a chain conveyor, or any other suitable conveying device known in the art. The first transfer conveyor 46 is configured to position each log eighth wedge 44 so that an apex 88 of the wedge 44 is adjacent to a stop member 90 of the resawing rig 50.

In order to keep the face 84 of the wedge 44 adjacent to the conveying device 86, a plurality of roller arms 92 that includes a series of roller bearings 94 on a shaft 96 is provided. At least one roller arm 92 is provided before the first band saw 54*a*, between adjacent band saws 54*a*-54*f* and after the last band saw 54*f*. The roller arm 92 is attached to the support table 98 in a 45 degree hole 100 drilled in bar stock 102 that is attached to the support table 98. In some embodiments, a plurality of hold down devices or powered wheels 82 (as described above) may be used to keep the wedge 44 in position for sawing so that the flat face 84 adjacent to the conveying device 86 and a flat face 104 is adjacent to the roller arms 92. The hold-down device or powered wheel 82 may be attached to resawing rig 50 or support table 98 by any means known by those skilled in the art. Accordingly, for visualization purposes of other details of the resawing rig 50, the details of the hold-down or powered wheel 82 are not shown.

As shown in FIG. 8, each band saw 54*a* to 54*f* is positioned at a predetermined different height above the conveying device 86 so that a series of slices of lumber can be cut from each log eighth wedges 44 that passes through the resawing rig 50. Each band saw is also position parallel to the conveying device 86. As the wedge 44 is moved from an entrance end to an exit end of the resawing rig, the wedge is first cut by band saw 54*a* then each band saw 54*b*-54*c* in succession. Accordingly, only a single pass of the wedge 44 through the resawing rig 50 is required to provide a plurality of lumber pieces. The number of band saws 54*a*-54*f* required to saw the wedge 44 in a single pass through resawing rig 50 depends on the size of the wedge and the size of thickness of lumber that is desired. A larger wedge 44 may require more than six band saws 54*a*-54*f*, and a smaller wedge 44 may require fewer than six band saws 54*a*-54*f* for providing the same thickness of lumber.

By providing the transport rig 38 to saw each log quarter wedge 34 into two log eighth wedges 44 by making a cut through the apex 62 of the wedge 34 and combining the transport rig 38 with the resawing rig 50 wherein a plurality of cuts to log eighth wedge 44 made parallel to one face 84 of the wedge 44 the highest yield of quartersawn lumber can be obtained from a log. There is very little waste obtained from a log using the rigs and methods described herein. Also, the band saws 54*a*-54*f* can be placed close to one another and at different heights so that a single pass through the resawing rig 50 can produce much more lumber with much less manpower than sawmills that obtain only a single cut per pass of the wedge 44 through a saw blade.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A sawmill comprising:

a band saw configured to saw a log quarter wedge segment into two log eighth wedge segments;

a supply conveyor configured to supply the log quarter wedge segment to a log transport rig configured to orient the log quarter wedge segment so that an apex of the log quarter wedge segment is oriented in a downward direction, wherein the log transport rig is configured to move the log quarter wedge segment through the band saw, wherein the two log eighth wedge segments have at least one flat face;

a resawing rig comprising a conveying device and from two to six band saws oriented parallel to a flat face of each of the two log eighth wedge segments prior to cutting each of the two log eighth wedge segments;

wherein the resawing rig comprises rollers attached to the resawing rig at an angle of 45 degrees, wherein the rollers are configured to contact only one flat face of each of the two log eighth wedge segments as each of the two log eighth wedge segments are transported through the resawing rig; and a transfer conveyor configured to gather the two log eighth wedge segments from the log transport rig and feed the two log eighth wedge segments sequentially to the resawing rig configured to saw boards from the each of two log eighth wedge segments in succession as each of the two log eighth wedge segments are transported through the resawing rig on the conveying device.

2. The sawmill of claim 1, wherein each of the two to six band saws of the resawing rig is set at a different height relative to the flat face of each of the two log eighth wedge segments prior to cutting each of the two log eighth wedge segments.

3. The sawmill of claim 1, wherein the resawing rig comprises three band saws in succession.

4. The sawmill of claim 1, wherein the resawing rig comprises four band saws in succession.

5. The sawmill of claim 1, wherein the resawing rig comprises five band saws in succession.

6. The sawmill of claim 1, wherein the resawing rig comprises six band saws in succession.

7. The sawmill of claim 1, wherein each of the rollers comprises a shaft and a plurality of roller bearings on the shaft.

8. The sawmill of claim 1, wherein at least one of the at least two rollers are disposed between adjacent band saws.

9. The sawmill of claim 1, wherein the log transport rig further comprises a first log hold-down fixture.

10. The sawmill of claim 1, wherein the resawing rig comprises a second log hold-down fixture.

11. A method for sawing a log comprising, feeding a log quarter wedge segment from a supply conveyor to a log transport rig;

orienting the log quarter wedge segment in the log transport rig so that an apex of the log quarter wedge segment is in a downward direction;

transporting the log quarter wedge segment through a band saw;

sawing the log quarter wedge segment into two log eighth wedge segments;

transporting the two log eighth wedge segments on a conveying device in succession through a resawing rig containing two to six band saws, wherein the two to six band saws are oriented parallel to a flat face of each of the two log eighth wedge segments prior to cutting each of the two eighth wedge segments;

wherein the resawing rig comprises rollers attached to the resawing rig at an angle of 45 degrees, further comprising contacting only one flat face of each of the two log eighth wedge segments with the rollers as each of the two log eighth wedge segments are transported through the resawing rig; and sawing two or more boards parallel to one flat face of each of the two log eighth wedge segments as each of the two log eighth wedge segments are transported on the conveying device through the resawing rig.

12. The method of claim 11, further comprising setting each of the two or to six band saws at a different height above the conveying device in order to saw lumber from each of the two log eighth wedge segments in a direction parallel to the one flat face of each of the two log eighth wedge segments prior to cutting each of the two log eighth wedge segments.

13. The method of claim 11, wherein the resawing rig comprises three band saws in succession.

14. The method of claim 11, wherein the resawing rig comprises four band saws in succession.

15. The method of claim 11, wherein the resawing rig comprises five band saws in succession.

16. The method of claim 11, wherein the resawing rig comprises six band saws in succession.

17. The method of claim 11, wherein each of the rollers comprises a shaft and a plurality of roller bearings on the shaft.

18. The method of claim 11, wherein at least one of the at least two rollers are disposed between adjacent band saws.

19. The method of claim 11, further comprising holding down the log quarter wedge segment with a first log hold-down fixture during sawing.

20. The method of claim 11, further comprising holding down each of the two log eighth wedge segment with a second log hold-down fixture during sawing.

* * * * *